United States Patent [19]

Riemer

[11] Patent Number: 5,024,339

[45] Date of Patent: Jun. 18, 1991

[54] PLASTICS BOTTLE

[75] Inventor: Horst H. Riemer, Mid Glamorgan, England

[73] Assignee: Mendle Limited, United Kingdom

[21] Appl. No.: 484,092

[22] Filed: Feb. 23, 1990

[30] Foreign Application Priority Data

Feb. 27, 1989 [GB] United Kingdom ..... 8904417

[51] Int. Cl.[5] ..... B65D 1/02; B65D 23/00

[52] U.S. Cl. ..... 215/1 C; 220/606

[58] Field of Search ..... 215/1 C; 220/606, 633, 220/635

[56] References Cited

U.S. PATENT DOCUMENTS

| | | | |
|---|---|---|---|
| 3,403,804 | 10/1968 | Colombo | 215/1 C X |
| 3,727,783 | 4/1973 | Carmichael | 215/1 C |
| 3,935,955 | 2/1976 | Das | 215/1 C |
| 4,249,667 | 2/1981 | Pocock et al. | 215/1 C |
| 4,285,949 | 11/1988 | Kaishnakurar et al. | 215/1 C |
| 4,294,366 | 10/1981 | Chang | 220/606 X |
| 4,318,489 | 3/1982 | Snyder et al. | 215/1 C |

FOREIGN PATENT DOCUMENTS

| | | | |
|---|---|---|---|
| 225155 | 6/1987 | European Pat. Off. | 215/1 C |
| 8605462 | 9/1986 | PCT Int'l Appl. | 220/70 |

*Primary Examiner*—Sue A. Weaver

*Attorney, Agent, or Firm*—Sughrue, Mion, Zinn, Macpeak & Seas

[57] ABSTRACT

A plastics bottle for carbonated drinks has a side wall (4) and a base (5) formed with a central area (8) surrounded by circumferentially spaced projecting feet (6) separated by substantially parallel-sided straps (7). The central area (8) and the straps (7) define a continuous smooth domed surface with no re-entrant portions. The ratio of the combined width of the straps (7) to the outside circumference of the base (5) is in the range from 1:5.5 to 1:6.5 and preferably 1:6. Preferably the base (5) has only seven projecting feet (6). This configuration is particularly useful with bottles of small size and enables a saving in plastics material of up to 40% by weight.

18 Claims, 3 Drawing Sheets

PLASTICS BOTTLE

BACKGROUND OF THE INVENTION

The present invention relates to plastics bottles and in particular to bottles for carbonated drinks.

In designing bottles for carbonated drinks care has to be taken to provide a structure capable of withstanding the pressures resulting from several volumes of carbonation. This is made more difficult when the ambient temperature is high; partly as a result of the thermoplastic nature of the plastics material and partly as a result of the solubility of carbon dioxide in the beverage decreasing with increasing temperature. In practice it is found that failure of bottles under pressure tends to occur at the base. Typically the plastics material in the base creeps and so is gradually extended. Accordingly in many widely used designs for plastics bottles the base has a domed, generally hemispherical shape like that of a pressure vessel. Although such a shape is able to withstand high pressures with little creep it is not inherently stable and so the base has to be provided with a flat-bottomed outer base cup so that the bottle can stand upright. The outer base cup also accommodates what creep takes place.

To overcome the disadvantages of such designs requiring the use of a separate outer base cup to provide stability it has been proposed to use bottles with a "Champagne" base or a castellated base including a number of projecting feet. To produce a "Champagne" base the bottle is first blown to have a domed base and then, whilst still hot and mouldable the domed base is pushed upwards into the bottle with a round nosed tool. This form of base is particularly popular with PET bottles of small capacity, for example those having a capacity of half a litre or less, and it is this shape which is most commonly used for such bottles. An example of a PVC bottle which is blown into a mould to form it with a similar base is described in GB-A-1237402. Castellated bases are more usually used on bottles of larger capacity, typically a litre or more. Examples of such bottles are described in GB-A-1360107, U.S. Pat. No. 3,935,955, U.S. Pat. No. 4,318,489, EP-A-0028125, and WO86/054,62. Our earlier European application EP-A-225155 also shows such a bottle having seven feet formed in the base which makes it particularly stable. Although such designs have been found to be generally satisfactory in both withstanding pressure without everting and offering good handling properties, it is difficult to ensure that there is sufficient material in the base of the bottle to form the feet without undue local thinning of the walls and to provide the necessary strength. One way in which this can be achieved is by increasing the wall thickness of the plastics material in the bottle as a whole. However the amount of plastics material used to form the bottle is a major factor in determining the price of the bottle and so it is undesirable to increase the amount of plastics material used.

GB-A-b 1360107 describes a plastics bottle for carbonated drinks which has a side wall and a base formed with a central area surrounded by circumferentially spaced projecting feet separated by substantially parallel-sided straps lying on a domed surface. The central area of the base includes an annular re-entrant ring having a substantial extent in the axial direction of the bottle to buttress the base of the bottle. This re-entrant ring is described as acting as a structural arch to resist the internal pressure within the bottle and it is typically formed by pushing an annular tool upwards against the base of the bottle during its blowing step in a similar fashion to the formation of the recessed "Champagne" type base. In some examples the central area of the base is recessed into the annular ring so that any creep of the base does not result in the central area moving downwards farther than the plane defined by the feet. A similar arrangement with a recessed base is also shown in U.S. Pat. No. 4,318,489.

SUMMARY OF THE INVENTION

According to this invention a plastics bottle for carbonated drinks which has a side wall and a base formed with a central area surrounded by circumferentially spaced projecting feet separated by substantially parallel-sided straps lying on a domed surface is characterised in that the central area and the straps define a continuous smooth domed surface with no re-entrant portions, and in that the ratio of the combined width of the straps to the outside circumference of the base is in the range from 1:5.5 to 1:6.5.

The present inventor has found that the performance of plastics bottles of the type having projecting feet depends critically on certain design parameters and in particular on having the straps between the feet being of sufficient width to define an adequate domed pressure-resisting structure whilst at the same time being sufficiently narrow so that both the feet and the straps are stretched to substantially the same extent with no local stretching which would tend to thin their wall thickness to too great an extent. These conflicting requirements can both be met by designing the base to have the ratio of the total width of the straps to the circumference of the base to fall within the above range and preferably to be substantially 1:6.

As the bottle is formed by a blow moulding technique the plastics material is bi-axially oriented. The plastics material reaches a maximum tensile strength when it has been stretched to a predetermined degree. For PET this stretch ratio is 1:10.5. Thus whilst it is important to get a sufficient degree of stretch in two different directions and hence bi-axial orientation, too much stretching results in a weakened portion. In conventional bottle designs whether of the domed base type, "Champagne" base type or castellated type the bases are not bi-axially oriented sufficiently and often the stretching only occurs in one direction and is not uniform over the base. This is one of the reasons why, as their tensile strength is low, conventional bases creep and evert as a result of the internal pressure and, to prevent this, why the bases are made thicker so that there is a greater quantity of plastics material present to resist the internal pressure. By using the optimum ratio between the feet and the straps and having the straps parallel sided, this avoids local thinning and over-stretching of the wall thickness of the bottle and achieves a very much more uniform bi-axial orientation throughout the feet and straps. The degree of bi-axial orientation in this region approaches that in the side wall. Thus rather than reinforce the base by using more plastics material as is conventional, in bottles in accordance with this invention the base is strengthened by obtaining more complete and uniform bi-axial orientation of the plastics material in it without any over-stretching.

The present invention has particular application to bottles of smaller capacity such as those of nominal capacity of 500 ml and below and with such small bottles it is generally very much more difficult to make them strong enough than it is for bottles of larger capacity. This is as a result of the plastics material not being stretched to its optimum extent during blowing and thus not being bi-axially oriented to such a great extent as bottles of larger capacity. Preferably the plastics material is stretched during its formation so that the wall thickness of the side wall, feet and straps is not greater than 0.3 mm at any point, irrespective of the capacity of the bottle. Since the plastics material is stretched to such an extent during its formation it is very much preferred that the bottles are made by the injection-stretch blow moulding technique in which a preform or parison is initially injection moulded before being stretched and blown. Injection moulded preforms are better able to withstand the subsequent stretching operations to bi-axially orient their bases than those made by extrusion where the base includes a seam.

Preferably the base has only seven projecting feet. Preferably the radius of curvature of the domed surface defined by the straps falls within the range from 75% to 85% of the outside radius of the base.

Preferably the feet extend to a depth below the central region of the domed surface to a depth in the range 6–8% of the outside diameter of the base. It is further preferred that the feet extend to a depth of substantially 7% of the outside diameter of the base.

Preferably each foot comprises an inwardly tapered side portion and a generally triangular bottom portion which tapers towards its radially innermost end, which are connected by a curved portion having a radius of curvature which is substantially one third the strap radius. Preferably the side portion is curved with a radius of curvature which is substantially three times the strap radius.

Preferably the stand diameter of the feet falls within the range 66–76% of the outside diameter of the base. The stand diameter is the diameter of a circle defined by the outermost regions of contact of the feet with a plane surface when the bottle is standing upright on that surface. It is found that in particular with a bottle having seven feet and a stand diameter in the specified range excellent stability and handling properties are achieved, making the bottle particularly suitable for handling on high-speed conveyors.

Surprisingly, by using such selected narrow ranges for these design parameters it is found possible to reduce the quantity of plastics material needed for the bottle as a whole. Typically conventional bottles require forty per cent more plastics material to withstand the same internal pressure. This saving in the material required is very much greater than that routinely achieved by developments in this field and gives a bottle formed in accordance with the present invention marked commercial advantages.

Not only is a considerable saving in plastics material achieved but both the preform and the finished bottle have a smaller wall thickness. This means that the injection moulding cycle for the preform and the time that the finished bottle must remain in the blow mould is reduced, typically by 15–20% with consequent increases in throughput and efficiency.

BRIEF DESCRIPTION OF THE DRAWINGS

Examples of bottles in accordance with the present invention will now be described in detail with reference to the accompanying drawings; in which.

DESCRIPTION OF PREFERRED EXAMPLES

Figure 1:
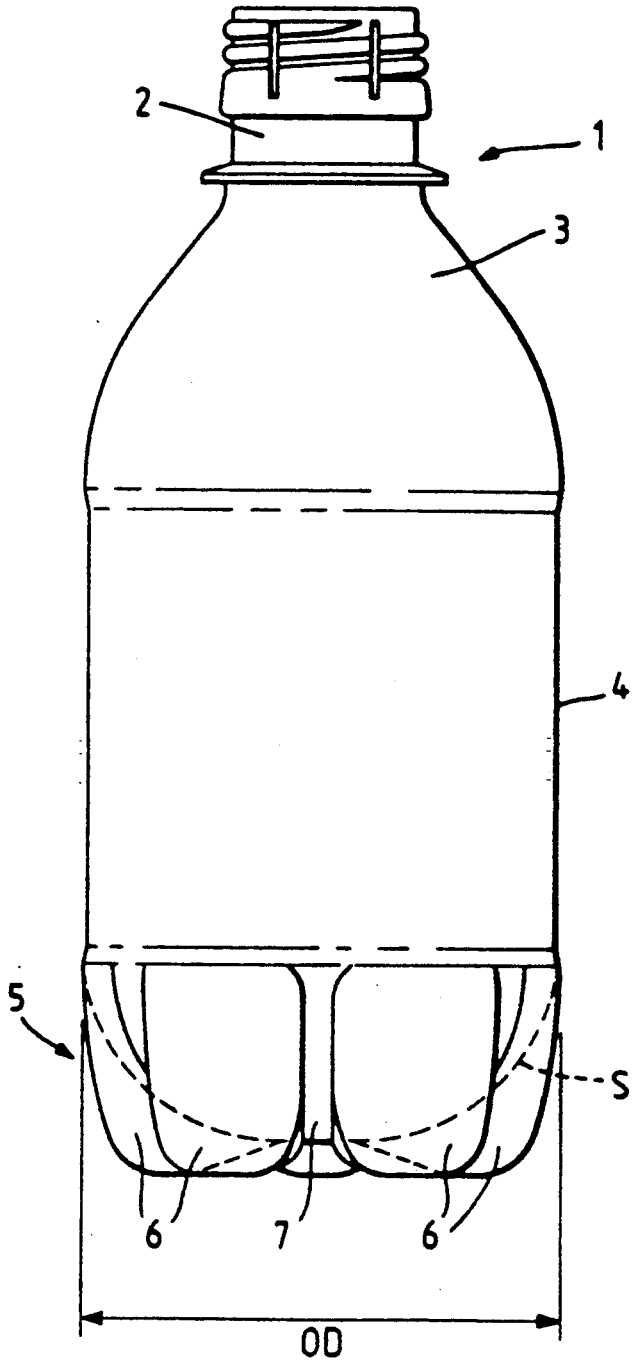
FIG. 1 is a side elevation.
Figure 2:
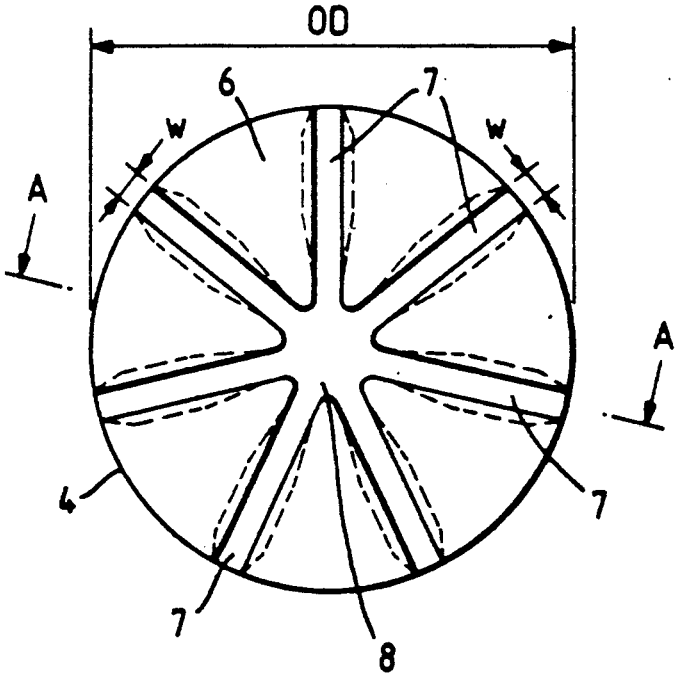
FIG. 2 is a bottom view.

A plastics bottle for carbonated drinks is made by an injection-stretch blow moulding technique and comprises an upper portion 1 including a neck 2 and shoulder 3, a generally cylindrical main body portion including a side wall 4 and a base 5. In the specific example described the bottle is blow-moulded from PET (polyethylene terepthalate) but the invention is equally applicable to different plastics materials such as PVC, polypropylene, high or low density polythene, or multi-layers including at least one of these.

The base 5 includes seven equi-angularly spaced downwardly projecting feet 6. Generally parallel sided straps 7 between the feet 6 and a central area 8 define a smooth domed generally pressure-vessel-shaped surface S. This surface S is roughly hemispherical but the central area 8 may be flat. The surface S is entirely convex, as seen from outside with no re-entrant portions.

Figure 3:
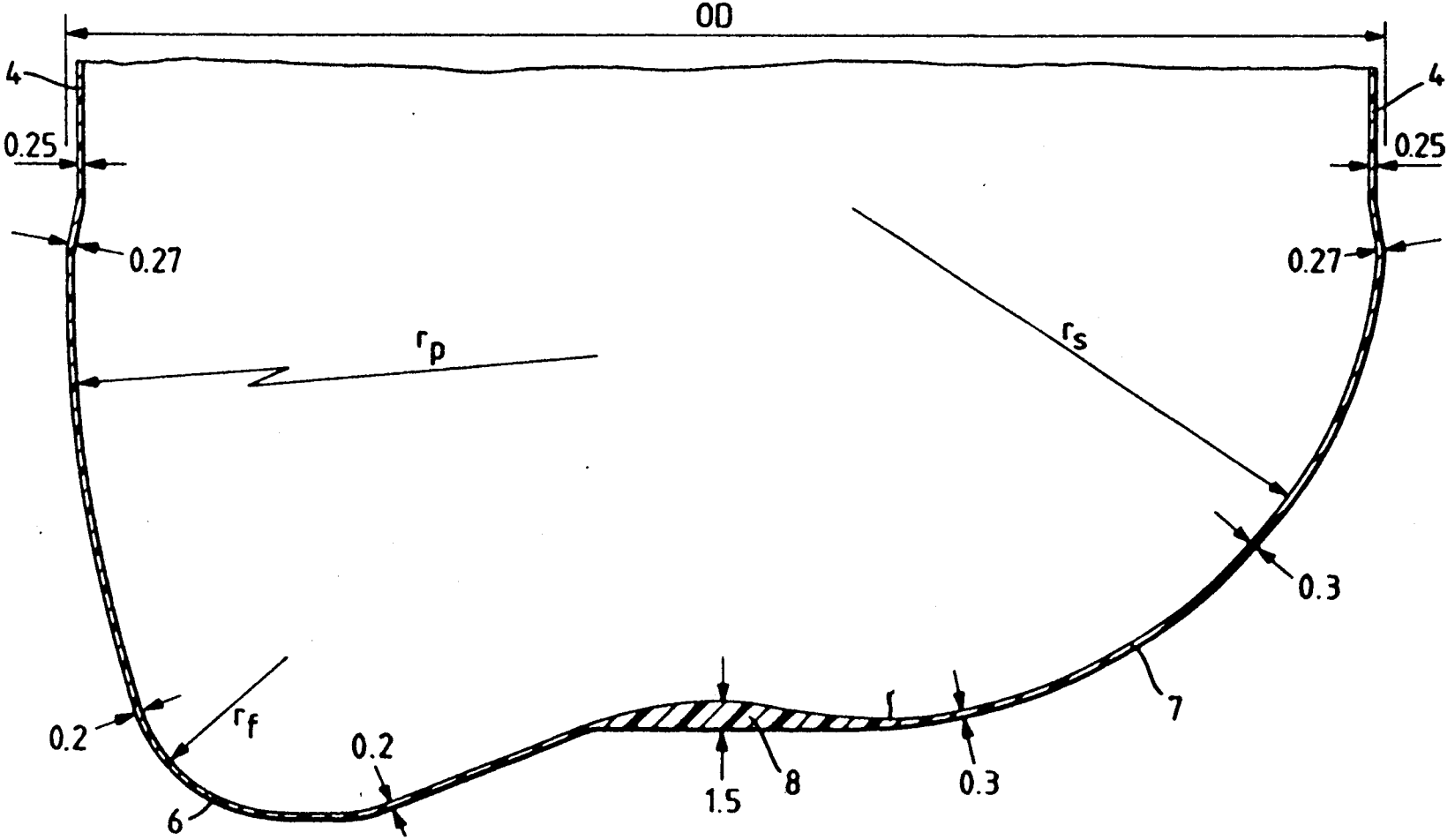
FIG. 3 is a section on line A—A of FIG. 2 drawn to a larger scale.

The wall thickness of the bottle is indicated in FIG. 3. These dimensions are taken from the 330 ml size bottle but are typical of all sizes. This shows that the wall thickness in the feet 6 and straps 7 is substantially similar to that in the side wall 4. This indicates that both are bi-axially oriented to a similar degree. Only the central region 8 is significantly thicker and this has only a very limited extent. All dimensions are shown in mm.

The total widths occupied by the feet and the straps respectively are found to have a significant effect on the properties of the bottle. In the present examples the ratio of the total width of all the straps to the circumference corresponding to the outside diameter OD is substantially 1:6. The outside diameter OD is defined as the diameter of the projection of the widest portion of the base onto the plane of the feet as shown in FIG. 1. Table 1 shows the strap width and outside diameters for bottles of volumes 185, 250, 330 ml and 500 ml respectively. In the case of the 330 ml bottle, for example, each of the straps has a width w of 4.8 mm. The total width of all seven straps is therefore 33.6 mm. The circumference associated with the outside diameter OD is 201 mm, giving the desired ratio of substantially 6:1.

Each of the straps 7 has a radius of curvature $r_s$, the strap radius, which is 81% of the radius associated with the outside diameter. The radii for the three different bottle sizes are shown in Table 2. The straps blend into the central region 8 at the centre of the surface S. Table 3 shows the diameters for the central region 8 in the different bottle sizes.

The base portions of the feet taper inwardly and slope upwardly to meet the surface S defined by the straps 7 towards the central region 8. Towards its radially outermost and broader end each base portion includes a flattened region on which the foot rests when the bottle is standing upright on a plane surface. The stand diameter is then the diameter of the circle defined by the outer edge of the region of contact between the feet and the surface on which the bottle stands. It is found that to provide the desired stability this stand diameter should be in the range 66 to 76 percent of the outside diameter of the bottle. Table 4 shows the minimum stand diameters for the four different bottle sizes.

The base portion meets the side portion of the foot 6 at a curved portion which has a radius of curvature $r_f$ which is approximately one third the strap radius. The side portion itself is gently curved with a radius of curvature $r_p$ which is three times the strap radius.

The depth of the seven feet is chosen to provide sufficient clearance for the surface S whilst maintaining optimum stability for the bottle and minimizing the amount of plastics material required for each foot. This depth as measured from the height of the generally flat central region to the lowermost part of the feet is 7% of the outside diameter of the bottle. Table 5 shows the depth of the feet for the three sizes of bottle.

The tapered shape of the base portions of the feet and the positions of the feet relative to the surface S minimize the distances between the flattened portions of adjacent feet and enhances the stability of the bottle. The number and configuration of the feet is also found to improve the handling properties of the bottle in automated filling lines by reducing its susceptibility to entrapment between the different plates of a conveyor of the type commonly used in bottling plants. For a 250 ml bottle the distance between the flattened regions of adjacent feet is 11.2 mm and for the 330 ml bottle the distance is 13.0 mm. The overall height of the base from the edge of the generally cylindrical main body portion down to the lowermost portion of the feet also affects the stability of the bottle and the relative distribution of the material between the base and the rest of the bottle. The height of the base is equal to the sum of the depth of the feet as defined above and the strap radius. Table 6 lists maximum values for the height of the base. This maximum height may be reduced by as much as 10%. If this is done then the area of the central flat region of the surface S is correspondingly increased.

Table 7 lists the total weight of each size of bottle and includes the weight of a comparable bottle currently on the market of similar capacity and intended for the same end use. The comparative bottles are made by Carters Drinks Group Limited, of Kegworth, Derby, U.K., are also made of PET but include a "Champagne" type base.

The bottles as described above realize a saving of substantially 40% in the weight of plastics material required for a bottle of particular capacity. For example, using prior art designs a 330 ml blow-moulded PET bottle requires 26 g of plastics material. By contrast, the 330 ml bottle described above requires only 17 g of plastics material. Despite the reduction in the quantity of plastics material used, the bottles of the present invention retain their ability to withstand pressure. In a test commonly used for bottles intended to contain carbonated soft drinks the bottle is filled with carbonated liquid having four volumes of carbonation and exposed to a temperature of 38° C. for twenty-four hours. The bottle is then examined to make sure that the base is intact, does not rock and has not everted. As a second part of this test the hot bottles are then dropped 2 meters onto a 50 mm thick steel plate on their bases to see if they survive intact. Bottles in accordance with this invention successfully pass both parts of this test.

TABLE 1

| BOTTLE SIZE ml | OUTSIDE DIAMETER mm | CIRCUMFERENCE mm | STRAP WIDTH mm | TOTAL STRAP WIDTH mm | RATIO |
|---|---|---|---|---|---|
| 185 | 51 | 160.2 | 3.8 | 26.6 | 1:6.02 |
| 250 | 56.4 | 177.2 | 4.2 | 29.4 | 1:6.03 |
| 330 | 64 | 201.1 | 4.8 | 33.6 | 1:5.98 |
| 500 | 70 | 219.8 | 5.2 | 36.6 | 1:6.00 |

TABLE 2

| BOTTLE SIZE ml | $r_s$ mm |
|---|---|
| 185 | 20.7 |
| 250 | 22.9 |
| 330 | 26.0 |
| 500 | 28.4 |

TABLE 3

| BOTTLE SIZE ml | DIAMETER OF CENTRAL AREA mm |
|---|---|
| 185 | 9.6 |
| 250 | 10.6 |
| 330 | 12.0 |
| 500 | 13.2 |

TABLE 4

| BOTTLE SIZE ml | MIN. STAND DIAMETER mm |
|---|---|
| 185 | 33.7 |
| 250 | 37.2 |
| 330 | 42.2 |
| 500 | 46.2 |

TABLE 5

| BOTTLE SIZE ml | DEPTH OF FOOT mm |
|---|---|
| 185 | 3.6 |
| 250 | 4.0 |
| 330 | 4.5 |
| 500 | 4.9 |

TABLE 6

| BOTTLE SIZE ml | BASE HEIGHT mm |
|---|---|
| 185 | 24.3 |
| 250 | 26.8 |
| 330 | 30.5 |
| 500 | 33.3 |

TABLE 7

| BOTTLE SIZE ml | WEIGHT gm | WEIGHT OF CONVENTIONAL BOTTLE gm | MATERIAL SAVING % |
|---|---|---|---|
| 185 | 14.5 | 20.0 | 23 |
| 250 | 15.8 | 22.6 | 30 |
| 330 | 17.0 | 25.0 | 32 |
| 500 | 24.8 | 32.8 | 24 |

I claim:

1. In a plastics bottle for carbonated drinks having a side wall, a base, a central area in said base, circumferentially spaced projecting feet in said base surrounding said central area, and substantially parallel-sided straps lying between and separating said spaced projecting feet, the improvement wherein said central area and said straps together define a continuous smooth domed surface with no re-entrant portions, and wherein a ratio of the combined width of said straps to the outside circumference of said base is in a range from 1:5.5 to 1:6.5.

2. A plastics bottle according to claim 1, wherein said ratio of said combined width of said straps to said outside circumference of said base is substantially 1:6.

3. A plastics bottle according to claim 2, wherein said base has only seven projecting feet.

4. A plastics bottle according to claim 3, which is made by an injection-stretch blow moulding technique.

5. A plastics bottle according to claim 4, wherein a radius of curvature of said domed surface defined by the straps falls within a range from 75% to 85% of the outside radius of said base.

6. A plastics bottle according to claim 5, wherein said feet extend below said central area to a depth in a range from 6 to 8% of the outside diameter of said base.

7. A plastics bottle according to claim 6, wherein each said foot comprises an inwardly tapered side portion, a generally triangular bottom portion, said generally triangular bottom portion tapering towards its radially innermost end, and a curved portion, said curved portion connecting said side and bottom portions and having a radius of curvature which is substantially one third of the radius of curvature of said straps, and wherein said side portion is curved with a radius of curvature which is substantially three times said radius of said straps.

8. A plastics bottle according claim 7, wherein a stand diameter of said feet falls within a range from 66 to 76% of the outside diameter of said bottle, said stand diameter being defined as the outside diameter of a circle touching outermost regions of contact of said feet with a plane surface when said bottle is standing upright on that plane surface.

9. A plastics bottle according to claim 8, wherein a wall thickness of said side wall, feet and straps is not greater than 0.3 mm.

10. A plastics bottle according to claim 9, wherein said bottle has a nominal capacity of between 185 ml and 500 ml.

11. A plastics bottle according to claim 1, wherein said base has only seven projecting feet.

12. A plastics bottle according to claim 1, which is made by an injection-stretch blow moulding technique.

13. A plastics bottle according to claim 1, wherein a radius of curvature of said domed surface defined by the straps falls within a range from 75% to 85% of the outside radius of said base.

14. A plastics bottle according to claim 1, wherein said feet extend below said central area to a depth in a range from 6 to 8% of the outside diameter of said base.

15. A plastics bottle according to claim 1, wherein each said foot comprises an inwardly tapered side portion, a generally triangular bottom portion, said generally triangular bottom portion tapering towards its radially innermost end, and a curved portion, said curved portion connecting said side and bottom portions and having a radius of curvature which is substantially one third of the radius of curvature of said straps, and wherein said side portion is curved with a radius of curvature which is substantially three times said radius of said straps.

16. A plastics bottle according to claim 1, wherein a stand diameter of said feet falls within a range from 66 to 76% of the outside diameter of said bottle, said stand diameter being defined as the outside diameter of a circle touching outermost regions of contact of said feet with a plane surface when said bottle is standing upright on that plane surface.

17. A plastics bottle according to claim 1, wherein a wall thickness of said side wall, feet and straps is not greater than 0.3 mm.

18. A plastics bottle according to claim 1, wherein said bottle has a nominal capacity of between 185 ml and 500 ml.

* * * * *